US006176112B1

(12) United States Patent
Sykosch et al.

(10) Patent No.: US 6,176,112 B1
(45) Date of Patent: Jan. 23, 2001

(54) METHOD AND DEVICE FOR DYNAMIC ADJUSTMENT OF THE ROLL GAP IN A ROLL STAND OF A MILL TRAIN HAVING MULTIPLE STANDS

(75) Inventors: Ralf Sykosch, Weilersbach; Matthias Müller, Buckenhof, both of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/308,102

(22) PCT Filed: Oct. 23, 1997

(86) PCT No.: PCT/DE97/02473

§ 371 Date: Jul. 19, 1999

§ 102(e) Date: Jul. 19, 1999

(87) PCT Pub. No.: WO98/19802

PCT Pub. Date: May 14, 1998

(30) Foreign Application Priority Data

Nov. 4, 1996 (DE) ..... 196 45 420

(51) Int. Cl.[7] ..... B21B 37/48

(52) U.S. Cl. ..... 72/11.4; 72/8.6; 72/9.2; 72/205; 72/365.2

(58) Field of Search ..... 72/8.6, 8.9, 9.2, 72/11.4, 11.6, 11.8, 12.1, 12.3, 12.7, 205, 365.2

(56) References Cited

U.S. PATENT DOCUMENTS

| | | | | |
|---|---|---|---|---|
| 3,170,344 | | 2/1965 | Marrs . | |
| 4,909,055 | | 3/1990 | Blazevic . | |
| 5,101,650 | * | 4/1992 | Fapiano | 72/9.2 |
| 5,341,663 | * | 8/1994 | Knapp | 72/8 |
| 5,414,619 | * | 5/1995 | Katayama et al. | 364/151 |
| 5,479,803 | * | 1/1996 | Imanari | 72/8.6 |
| 5,495,735 | * | 3/1996 | Nishimura | 72/11.8 |
| 5,787,746 | * | 8/1998 | Ferreira | 72/11.4 |

FOREIGN PATENT DOCUMENTS

| | | |
|---|---|---|
| 34 42 313 | 5/1986 | (DE) . |
| 195 11 267 | 4/1996 | (DE) . |
| 0 618 021 | 10/1994 | (EP) . |
| 2 568 496 | 2/1986 | (FR) . |
| 2 134 669 | 8/1984 | (GB) . |
| 62-040925 | 2/1987 | (JP) . |
| 1-015211 | 1/1989 | (JP) . |
| 1-317612 | 12/1989 | (JP) . |
| 5-208207 | 8/1993 | (JP) . |

OTHER PUBLICATIONS

S. Duysters et al., "Dynamic Modeling of the Finishing Train Of Hoogovens's Hot Strip Mill and Optimization Thickness Control Parameters," 31 (1990) Dec. No. 4, pp. 8–15.

Kimura Kazuyoshi, "Advanced Gauge Control Technology For Hot Strip Mill," Journal of the Iron and Steel Institute of Japan (Tetsu–To–Hagane), 79 (1993) No. 3, pp. 120–127.

Gunter W. Rigler, "Improved Rolling Mill Automation By Means Of Advanced Control Techniques and Dynamic Simulation," IEEE Transactions on Industry Applications, vol. 32, No. 3, May/Jun. 1996.

* cited by examiner

*Primary Examiner*—Ed Tolan
(74) *Attorney, Agent, or Firm*—Kenyon & Kenyon

(57) ABSTRACT

A method of dynamic adjustment of the roll gap in a roll stand of a mill train having multiple stands for rolling a strip, with a strip stock, i.e., a loop, between two roll stands being adjusted or limited by a loop or a strip stock control, with the dynamics in adjustment of the roll gap being limited as a function of state variables of the mill train, in particular state variables of the loop or strip stock control.

15 Claims, 4 Drawing Sheets

METHOD AND DEVICE FOR DYNAMIC ADJUSTMENT OF THE ROLL GAP IN A ROLL STAND OF A MILL TRAIN HAVING MULTIPLE STANDS

This application is a 371 of PCT/DE97/02473 filed Oct. 28, 1997.

BACKGROUND INFORMATION

The present invention relates to a method and a device for dynamic adjustment of the roll gap in a roll stand of a mill train having multiple stands.

FIELD OF THE INVENTION

For strip rolling in a mill train as described, for example, U.S. Pat. No. 3,170,344 and an artivular by S. Duysters et al. entitled "Dynamic Modeling Of The Finishing Train of Hoogovens' Hot Strip Mill And Optimization of Thickness Control Parameter," Journal A, vol. 31, no. 4, Dec. 1, 1990, pp 8–15, describe that for strip rolling in a mill train, in hot wide strip finishing strip mill and optimization of thickness control parameters" Journal A, vol. 31, no. 4, Dec. 1, 1990, pages 8 through 15, XP00017, in particular in hot wide strip finishing mills, there is on average a greater deviation in thickness at the head of first strips and conversion strips due to technological factors. On the basis of the thickness measurement downstream from the finishing train, the object of thickness control is to adjust the deviating strip thickness to the original setpoint or an advantageously redisposed setpoint as quickly as possible. There is a disturbance in mass flow, hereinafter referred to as a mass flow disturbance of the first type, due to the required control action at the screw-down position, e.g., of the last stand. This disturbance is even greater, the more quickly the thickness error is eliminated. However, there is a different upper limit for each strip for the allowed mass flow disturbance and thus for the thickness control rate, and this limit is determined by the correction potential available in loop control for the steepness of disturbance, which depends on the rise error response of the control system.

In principle, the screw-down system, whether hydraulic gap control (HGC) or motor-driven gap control (MGC), has a higher dynamic response than the main drives, so it is possible for the screw-down system to generate mass flow disturbances whose correction would exceed the dynamic response of the controlling element of the loop control, and thus they can no longer in principle be corrected by the loop control Therefore, . . . the desired rate of correction of thickness errors and the allowed mass flow disturbances with respect to the loop control.

In addition to the greater mass flow disturbances due to the thickness control, i.e., mass flow disturbances of the first type which are relevant only at the head of the strip, substantial mass flow disturbances can also occur under certain conditions due to divergence effects of the AGC algorithm (AGC=automatic gauge control; a function of load roll gap disturbance compensation based on roll separating force) which is based on positive feedback. These disturbances, hereinafter referred to as mass flow disturbances of the second type, may occur with a distribution over the entire strip due to divergence effects. The AGC algorithm is based in principle on a positive feedback response in the manner of a geometric series. The series normally converges so that the screw-down position merges into a new steady-state end value after a load roll gap disturbance. In the event of the unfavorable mechanical condition whereby the screw-down and roll separating force measurement in the stand are arranged together (e.g., top-top) instead of opposite one another (e.g., top-bottom), the series may diverge for the duration of frictional grip occurring in the stand window, so the AGC algorithm then diverges until frictional grip is broken, resulting in considerable mass flow disturbances of the second type.

To prevent great mass flow disturbances of the first type, the thickness control is usually adjusted relatively slowly to always be on the safe side. The allowed mass flow disturbance is different with each strip and each roll stand, depending on the roll pass schedule, i.e., it depends on numerous influencing factors, but its size is unknown, so a considerable portion of the control rate which is actually possible with most strips is not utilized in this compromise.

To limit the effects of mass flow disturbances of the second type which are possible with certain constellations, only an AGC undercompensation factor of considerably less than one has proven feasible there so far. The resulting loss of efficiency in correcting skid marks, i.e., cold spots in the strip, would have to be accepted with this compromise.

SUMMARY

An object of the present invention is to provide a method and a device which avoids the above-mentioned disadvantages of known methods and devices.

The object is achieved according to the present invention by providing a method and device which dynamically adjusts the roll gap in a roll stand of a mill train having multiple stands for rolling a strip, with a strip supply, i.e., a loop, between two roll stands being adjusted and limited by loop or strip supply control, the dynamic response of the adjustment of the roll gap being limited as a function of state variables of the loop or strip stock control. Such a method has proven especially suitable in avoiding the above-mentioned disadvantages. The method of achieving this object according to the present invention is also superior to a strict limitation as a function of state variables of the mill train as described in European Patent No. 680,021 A1, for example, or a limitation described in German Patent No. 195 11 267 C1. Dynamic response in setting the roll gap is advantageously limited by limiting the rate at which the roll gap is adjusted. It has proven advantageous when reducing the roll nip in this way to perform the rate limitation independently of the rate limitation when increasing the roll gap.

The roll gap of roll stands in a mill train having multiple stands is usually adjusted by strip thickness controllers which determine the roll gap setpoint as a function of the system deviation of the thickness controller, i.e., the difference between a predetermined required strip thickness and the actual strip thickness. The size of the system deviation before entering the strip thickness controller is advantageously limited as a function of state variables of the loop or strip stock control.

In another advantageous embodiment of the present invention, the roll gap is adjusted according to a roll gap setpoint by a hydraulic gap control (HGC), with the rate of change of the additional HGC setpoint being limited according to FIG. 1 or an equivalent parameter. In an alternative advantageous embodiment of the present invention, the roll gap is adjusted by a motor-driven gap control (MGC), with the equivalent thickness system deviation being limited according to FIG. 2 or an equivalent parameter. Limitation of the additional HGC setpoint in hydraulic gap control and limitation of the equivalent thickness system deviation with motor-driven gap control have both proven to be especially suitable for limiting the rate in the adjustment of the roll gap.

In another advantageous embodiment of the present invention, the dynamic response and the rate of adjustment of the roll gap are limited as a function of at least one of the following parameters:

- strip stock upstream from the roll stand or an equivalent parameter;
- strip stock downstream from the roll stand or an equivalent parameter;
- system deviation of the loop or strip stock control, i.e., the difference between the setpoint and the actual value of the loop height or the strip stock, for the loop or the strip supply upstream from the roll stand;
- system deviation of the loop or strip stock control for the loop height or the strip stock downstream from the roll stand
- time derivative of the strip stock upstream from the roll stand;
- time derivative of the; strip stock downstream from the
- roll stand time derivative of the system deviation of the loop or strip stock control for the loop height or the strip stock upstream from the roll stand;
- time derivative of the system deviation of the loop or the strip stock control for the loop height or the strip stock downstream from the roll stand;
- roll separating force;
- motor current of the roll stand drive;
- rpm of the roll stand drive;
- torque of the roll stand drive;

It has proven especially advantageous to limit the rate of adjustment when increasing the roll gap as a function of the system deviation, i.e., the difference between the setpoint and the actual value, of the loop height or of the strip stock upstream and downstream from the roll stand.

DETAILED DESCRIPTION

Figure 1:
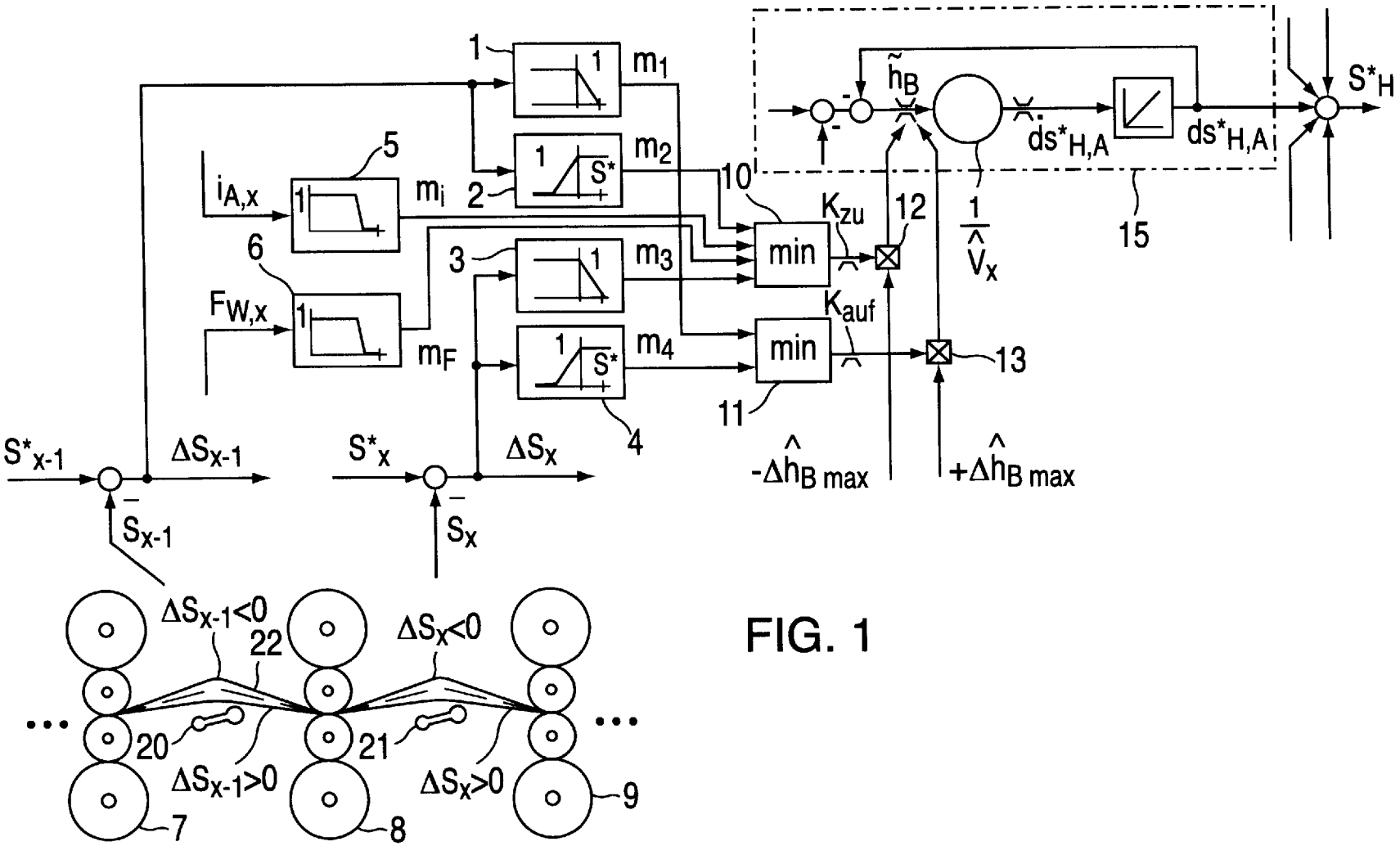
FIG. 1 shows a limitation of the roll gap adjusting rate with hydraulic gap control according to the present invention.
Figure 2:
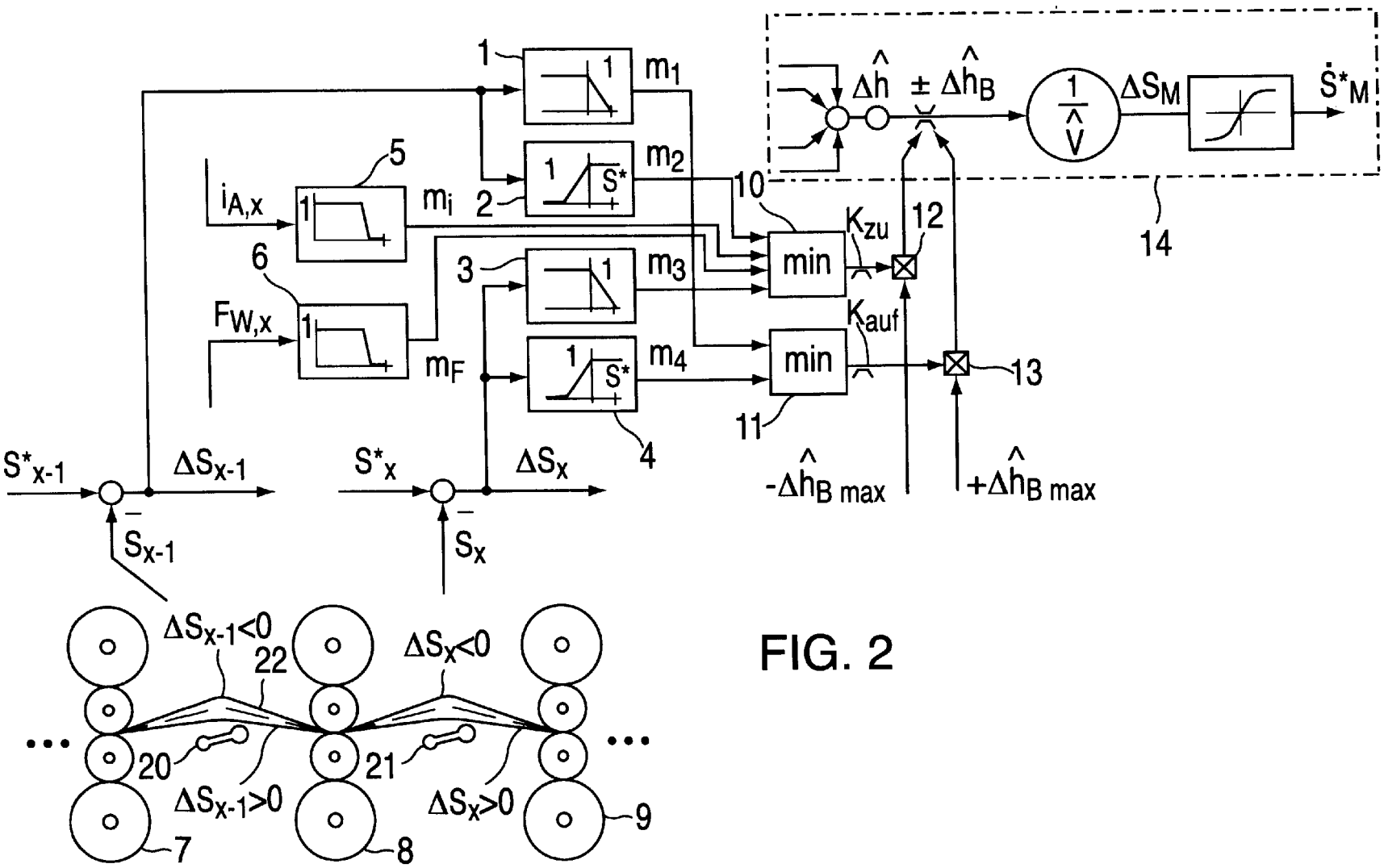
FIG. 2 shows a limitation of the roll gap adjusting rate with motor-driven gap control according to the present invention.

FIGS. 1 and 2 show two advantageous embodiments for limiting the state variable with hydraulic gap control (HGC) and motor-driven gap control (MGC). In the latter case, a suitable procedure may be implemented separately for thickness control.

FIGS. 1 and 2 show reference numbers 1, 2, 3, 4, 5 and 6 for matching functions, reference numbers 7, 8 and 9 for roll stands $x_{-1}$, x and $x_{+1}$ in a mill train having multiple stands, reference numbers 10 and 11 for minimum forming units and reference numbers 12 and 13 for multiplication points. Matching functions 1, 2, 3, 4, 5 and 6 and minimum forming units 10, 11 are part of a fuzzy system for forming reduction factors $k_{auf}$ and $k_{zu}$ for the rate limitation when increasing and reducing the roll gap. Loop lifters 20 and 21 are arranged between roll stands 7, 8, 9, for maintaining a predetermined tension in rolled strip 22. Depending on the condition in the mill train, strip supply s, which is equivalent to the screw-down angle of the loop lifter, is increased or decreased. In FIGS. 1 and 2, $s_{x-1}$ denotes the strip stock between roll stands 7 and 8, i.e., upsteam from roll stand x, and $s_x$ denotes the strip stock between roll stands 8 and 9, i.e., downstream from roll stand x. $s^*_{x-1}$ denotes the required strip stock between roll stand 7 and roll stand 8 and $s^*_x$ denotes the required strip stock between roll stand 8 and roll stand 9. According to FIGS. 1 and 2, difference $\Delta s_{x-1}$ and difference $\Delta s_x$ are formed between strip stock setpoint $s^*_{x-1}$ or $s^*_x$ and strip stock actual value $s_{x-1}$ or $s_x$. This difference $\Delta s_{x-1}$, $\Delta s_x$ can be used as a system deviation for controlling loop lifters 20 and 21, for example. Furthermore, difference $\Delta s_{x-1}$ merges into matching functions 1 and 2, and difference $\Delta s_x$ merges into matching functions 3 and 4.

Output variables of the matching functions are matching $m_1, m_2, m_3, m_4$. Furthermore, matches $m_i$ and $m_F$ are formed from armature current of the main drive $i_{A,x}$ and roll separating force $F_{w,x}$ on roll stand x by using matching functions 5 and 6. Matches $m_i$, $m_F$, $m_2$ and $m_3$ are sent to minimum forming unit 10, and matches $m_1$ and $m_4$ are sent to minimum forming unit 11. Minimum forming units 10 and 11 function as defuzzifiers.

Matching function 6 with which roll separating force $F_{w,x}$ merges is an optional additional extension. In this way, the function of overload protection can be implemented especially advantageously.

Matching function 5 with which main drive current $i_{A,x}$ merges is also an optional extension. By including this matching function 5, in particular the load redistribution performed regularly between successive stands by manual screw-down interventions at limit dimensions with regard to achieving main drive current limits can be secured automatically.

Output variables of fuzzy logic and thus of minimum forming units 10 and 11 are the two reduction factors $k_{auf}$ and $k_{zu}$ which are smaller than or equal to one and with which an upper and a lower variable limitation, acting on an intermediate variable which has an influence on the correcting rate of the screw-down system and is standardized to the rate of change in thickness, are adjusted according to worst case scenarios based on positive feedback so that the intermediate variable is adapted to mass flow changes which are evidently yet to be implemented by the loop control in the sense of flanking measures. Such an intermediate variable which influences the correcting rate of the screw-down system may be, for example, additional AGC setpoint $h_{\bar{B}}$ with two-loop AGC or additional AGC setpoint $ds^*_{H,A}$ for HGC, as shown in core structure 15 in HGC in FIG. 1. The state variable influencing the correcting rate of the screw-down system may also be, for example, equivalent thickness system deviation $\Delta\hat{h}$, as shown in core structure 14 in MGC in FIG. 2.

The basic consideration in designing the matching functions is that the direction of effect of screw-down changes on strip supplies of adjacent loops may have an improving or exacerbating trend, depending on the plus or minus sign of the strip stock control deviation. In the case of an improving trend, there is no reason for intervention; from the standpoint of that loop, the reduction factor may remain at one, i.e., without any effect. If it is an exacerbating trend, the rate of travel allowed instantaneously is decreased in the corresponding direction. However, this does not mean that the limitation is also reached here, because AGC and thickness control initially function independently of this measure. To this extent, loop-controlled dynamic limitation by using the limits, i.e., reduction factors $K_{auf}$ and $K_{zu}$, is only a flanking measure. By reducing the rate of travel, the loop causing this creates the prerequisite for rapid correction of strip stock.

Figure 3:
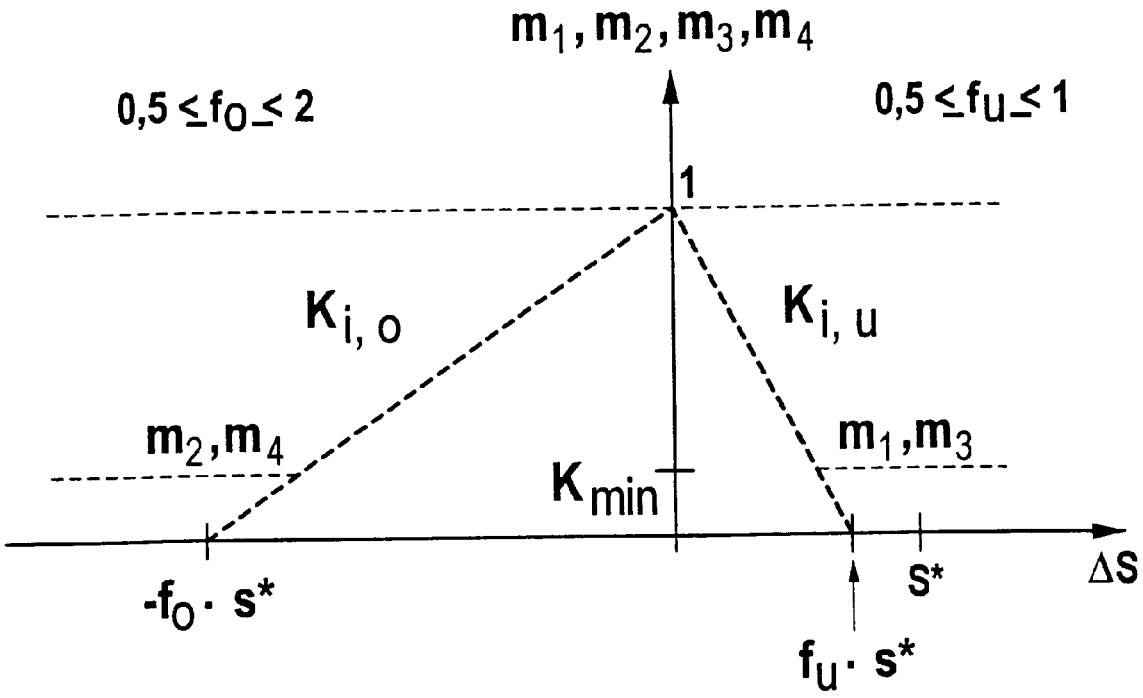
FIG. 3 shows a diagram for definition of the matching function according to the present invention.

FIG. 3 shows a possible advantageous method of defining the matching functions from FIGS. 1 and 2. The following indices are used in FIG. 3:

u=lower (loop too low) $\Delta s>0$ o=upper (loop too high) $\Delta s<0$ $\Delta s$=strip supply system deviation $\Delta s=s^*_x-s_x$ The maximum value for a positive $\Delta s$ is $s^*$ because the minimum value for s is zero (strip tight in the pass line, i.e., zero stock).

Negative values of $\Delta s$ may achieve much higher absolute values than $s^*$, so the criteria of the flanking measures need not be as strict here. Therefore, the matching function is projecting to the left, i.e., the zero pass of the slope is not limited to at most $s^*$, but instead it can be extended to $(-2)\cdot s^*$, for example, as assumed in the figure.

Zero passes for the specific angular projection are as follows:

$\Delta s>0$: $f_u\cdot s^*$, $0.5\leqq f_u\leqq 1.0$ $\Delta s<0$: $-f_o\cdot s^*$, $0.5\leqq f_o\leqq 2.0$ The ordinate is at 1.0 in each case. The linear equations for programming the fuzzy logic section by section are thus:

$$K_{i,u} = 1{,}0 - \frac{1}{f_u \cdot s^*} \cdot \Delta s \quad \text{for } m_1 \text{ and } m_3$$

$$K_{i,o} = 1{,}0 + \frac{1}{f_o \cdot s^*} \cdot \Delta s \quad \text{for } m_2 \text{ and } m_4$$

Figure 4:
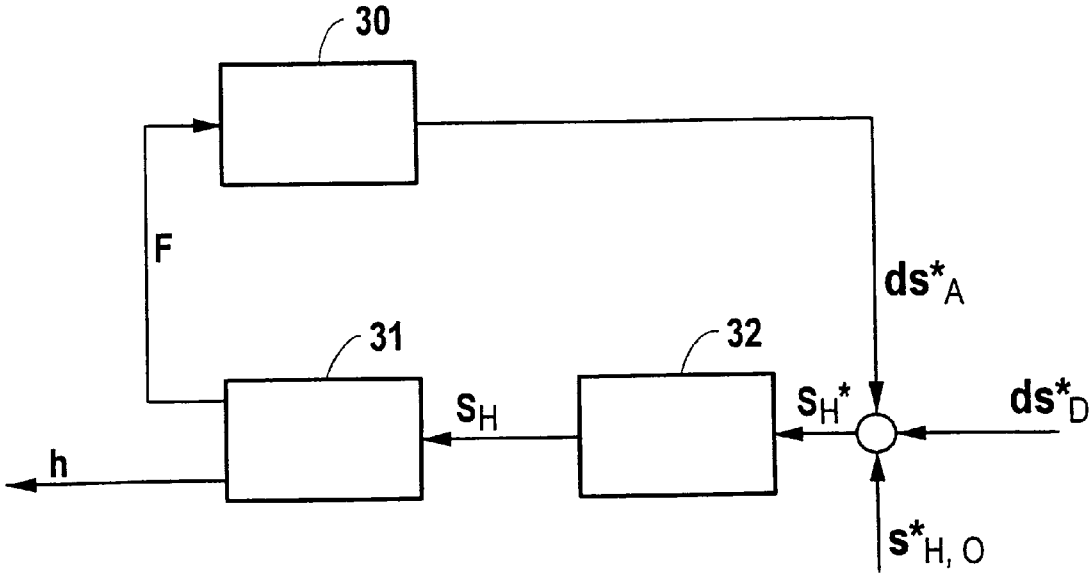
FIG. 4 shows the principle of hydraulic gap control according to the present invention.

FIG. 4 shows the principle of hydraulic gap control for adjusting a roll gap h in a roll stand 31. Roll separating force F is measured first and then sent to a load roll gap disturbance compensation circuit 30 (AGC). The output variable of this circuit 30 is $ds^*_{H,A}$. Sum $s^*_H$ from this additional AGC setpoint $dS^*_{H,A}$, the setpoint determined by the strip thickness control for roll gap $ds^*_D$ and basic screw-down position setpoint $s^*_{H,O}$ is the input variable for HGC position control circuit 32 which adjusts screw-down position $s_H$ for roll stand 31. In addition to the limitation on rate of increase or change in the additional AGC setpoint according to FIG. 1, the rates of increase or change in $ds^*_{H,A}$, $ds^*_D$ or the sum of $ds^*_{H,A}$, $ds^*_D$ and $s^*_{H,O}$ can also be limited.

Figure 5:
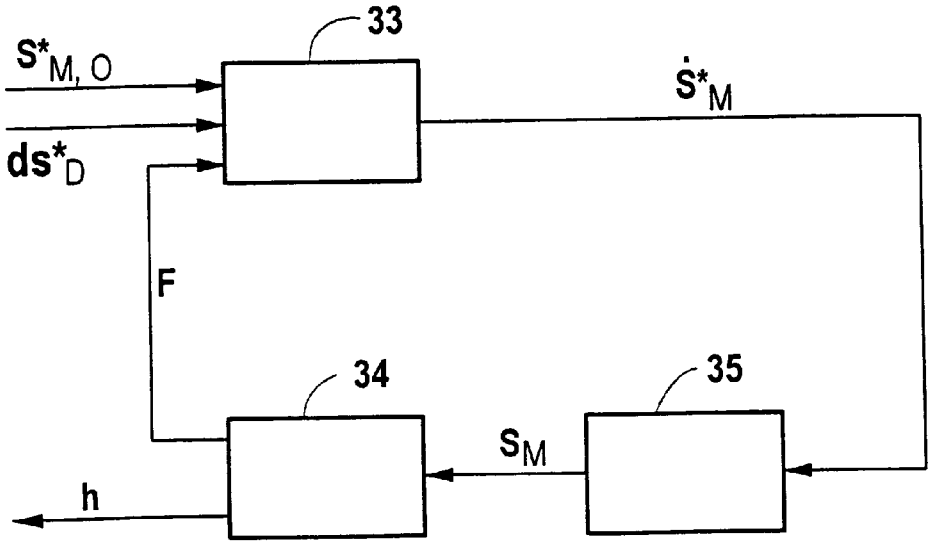
FIG. 5 shows the principle of motor-driven gap control according to the present invention.

FIG. 5 shows a schematic diagram of a motor-driven gap control for adjusting roll gap h in a roll stand 34. Roll separating force F is measured in roll stand 34 and sent together with basic screw-down position setpoint $S^*_{M,O}$ and an additional setpoint $ds^*_D$ for roll gap h determined by a strip thickness control to a motor-driven gap control 33. The output variable of motor-driven gap control 33 is a screw-down rate setpoint $s\cdot^*$ M, which is the input variable of a regulated motor 35. The output variable of the regulated motor is a screw-down position $s_M$.

What is claimed is:

1. A method of dynamically adjusting a roll gap in a roll stand of a mill train having multiple stands for rolling a strip, comprising the steps of:

adjusting a loop between two of the roll stands by a loop control;

dynamically adjusting the roll gap; and dynamically limiting dynamics of the dynamic adjustment of the roll gap as a real-time function of internal state variables of the loop control.

2. The method according to claim 1, further comprising the step of:

limiting a rate at which the roll gap is adjusted as a function of the state variables of the loop control.

3. The method according to claim 1, further comprising the step of:

limiting a rate at which the roll gap is reduced independently of a rate at which the roll gap is increased.

4. The method according to claim 1, further comprising the steps of:

adjusting the roll gap by a strip thickness controller, the roll gap being adjusted by controlling a roll gap setpoint as a function of a system deviation of the strip thickness controller, the system deviation being a difference between a predetermined required strip thickness and an actual strip thickness; and limiting a size of the system deviation before entering the strip thickness controller as a real-time function of the state variables of the loop control.

5. The method according to claim 1, wherein the adjusting the roll gap step includes the step of adjusting the roll gap by hydraulic gap control, a rate of change of the hydraulic gap control setpoint being limited to a predetermined rate.

6. The method according to claim 1, wherein the adjusting the roll gap step includes the step of adjusting the roll gap by motor-drive gap control, an equivalent thickness system deviation being limited to a predetermined deviation.

7. The method according to claim 1, further comprising the step of:

determining limit values to limit one of i) the dynamics of the adjustment of the roll gap, and ii) a rate of adjustment of the roll gap, the limit values being determined by one of fuzzy techniques and mapping techniques.

8. The method according to claim 1, further comprising the step of:

determining limit values to limit one of i) the dynamics of the adjustment of the roll gap, and ii) a rate of adjustment of the roll gap, the limit values being determined by neural networks.

9. The method according to claim 1, further comprising the step of:

determining limit values to limit one of i) the dynamics of the adjustment of the roll gap, and ii) a rate of adjustment of the roll gap, the limit values being determined as a function of at least one of:

a strip stock upstream from the roll stand;

a strip stock downstream from the roll stand;

a system deviation of a loop control for a loop upstream from the roll stand;

a system deviation of a loop control for a loop height downstream from the roll stand;

a system deviation of the strip stock downstream from the roll stand;

a time derivative of the strip stock upstream from the roll stand;

a time derivative of the strip stock downstream from the roll stand;

a time derivative of a system deviation of the loop control for a loop height upstream from the roll stand;

a time derivative of the system deviation of the loop control for a loop height downstream from the roll stand;

a roll separating force;

a motor current of a roll stand drive; and a torque of the roll stand drive.

10. The method according to claim 9, further comprising the step of:

limiting a rate of adjustment in increasing the roll gap as a real-time function of the system deviation of the loop height upstream from the roll stand and the system deviation of the loop height downstream from the roll stand.

11. The method according to claim 9, further comprising the step of:

limiting a rate of adjustment in reducing the roll gap as a real-time function of one of i) the system deviation in the loop height upstream from the roll stand and the system deviation in the loop height downstream from the roll stand, and ii) the system deviation in the strip stock upstream from the roll stand and the system deviation in the strip stock downstream from the roll stand, the rate of adjustment in reducing the rolling gap further being limited as a function of the motor current of the roll stand and a roll separating force.

12. A device for dynamically adjusting a roll gap in a roll stand of a mill train having multiple stands for rolling a strip, comprising:

a loop control adjusting a loop between two of the stands and dynamically adjusting the roll gap, dynamics of the dynamic adjustment of the roll gap being dynamically limited as a real-time function of state variables of the loop control.

13. A method of dynamically adjusting a roll gap in a roll stand of a mill train having multiple stands for rolling a strip, comprising the steps of:

determining an actual strip thickness;

determining a difference between a predetermined strip thickness and the actual strip thickness; and adjusting the roll gap as a function of the determined difference, a rate of adjustment of the roll gap being limited as a function of internal state variables of a loop control.

14. The method according to claim 13, wherein a rate at which the roll gap is reduced in independent of a rate what which the roll gap is increased.

15. A method of dynamically adjusting a roll gap in a roll stand of a mill train having multiple stands for rolling a strip, comprising the steps of:

adjusting a loop between two of the roll stands by a loop control;

dynamically adjusting the roll gap; and dynamically adjusting limitations of the dynamic adjustment of the roll gap as a real-time function of internal state variables of the loop control.

* * * * *